United States Patent [19]

Unkelbach et al.

[11] 4,116,839

[45] Sep. 26, 1978

[54] HIGH INTENSITY MAGNETIC SEPARATOR FOR WET SEPARATION OF MAGNETIZABLE PARTICLES OF SOLIDS

[75] Inventors: Karl-Heinz Unkelbach; Gottfried Duren, both of Cologne, Germany

[73] Assignee: Klockner-Humboldt-Deutz Aktiengesellschaft, Germany

[21] Appl. No.: 766,124

[22] Filed: Feb. 7, 1977

[30] Foreign Application Priority Data

Feb. 18, 1976 [DE] Fed. Rep. of Germany ..... 2606408

[51] Int. Cl.[2] ..... B03C 1/02

[52] U.S. Cl. ..... 210/222; 209/232

[58] Field of Search ..... 209/221, 232; 210/222

[56] References Cited

U.S. PATENT DOCUMENTS

| | | | |
|---|---|---|---|
| 3,375,925 | 4/1968 | Carpenter | 209/232 X |
| 3,608,718 | 9/1971 | Aubrey, Jr. et al. | 210/222 X |
| 3,830,367 | 8/1974 | Stone | 209/232 X |
| 3,849,301 | 11/1974 | Reading | 209/221 X |
| 3,920,543 | 11/1975 | Marston et al. | 209/232 X |
| 3,935,095 | 1/1976 | Susse et al. | 209/232 X |
| 3,988,240 | 10/1976 | Fraas | 210/222 X |

*Primary Examiner*—Frank A. Spear, Jr.

*Attorney, Agent, or Firm*—Hill, Gross, Simpson, Van Santen, Steadman, Chiara & Simpson

[57] ABSTRACT

A high intensity magnetic separator conveys particles of solids suspended in a carrier medium through a magnetic field between ferromagnetic bodies and has a rotor constructed of ferromagnetic material. The rotor rotates about an approximately vertical axis and has an arrangement of containers on the outer side which holds the ferromagnetic bodies. At least one magnetic system is fixed outside of the rotor and a portion of the rotor is included in the magnetic field between the poles of the magnetic system so that the field extends through the arrangement of containers. The rotor is constructed as a hollow body and the poles of different polarity are arranged together in alignment with one another in the magnetic system. A slurry of the material to be separated is charged into each container as the same is moved into the magnetic field, middle material may be flushed out of the containers as the same rotate out of the magnetic field and the magnetic concentrate is flushed out of the containers outside of the magnetic field. Several spaced apart magnetic fields of different intensity may be employed for selective separation of materials having different susceptibility.

10 Claims, 3 Drawing Figures

HIGH INTENSITY MAGNETIC SEPARATOR FOR WET SEPARATION OF MAGNETIZABLE PARTICLES OF SOLIDS

BACKGROUND OF THE INVENTION

1. Field of the Invention

The present invention relates to a high intensity magnetic separator for the wet preparation of magnetizable particles of solids, in which particles of solids suspended in a carrier medium forming a slurry or sludge or guided through a magnetic field between ferromagnetic bodies, and more particularly to such a separator which has a rotor or ferromagnetic material which supports an arrangement of containers on its periphery, the containers having ferromagnetic bodies therein, and which rotates about an approximate vertical axis, and at least one magnet system fixedly arranged outside of and adjacent the rotor and having a portion of the rotor located between its magnetic poles to close the magnetic flux through the rotor and the arrangement of containers.

2. Description of the Prior Art

The prior art recognizes a variety of high intensity magnetic separators such as, for example, the so-called Jones high intensity separator which is described in the publication "HUMBOLDT manufactures the JONES High Intensity Wet Magnetic Separator", published in English, West Germany, July, 1971, this publication being fully incorporated herein by this reference.

Briefly, the primary feature of the continuously operating Jones separator is the provision of one or two weak magnetic disc-shaped rotors having a diameter up to about 4 m and a thickness of about 20 cm which rotate between the poles of large electromagnets. The poles have the same thickness as the rotors and include in their width, in each case, about one-fourth of the periphery of the rotor.

The two rotors are located with respect to one another on the same vertical axis. On the periphery of the rotors is a number of boxes or containers in which grooved pole plates of weak magnetic material are located, which plates may be held at spacing of 0.5 to 3 mm peak spacing. The boxes are charged from above with a slurry which discharges again at the lower rim and is collected. The activity takes place in the magnetic field. In this connection, the magnetic particles adhere together with a small part of non-magnetic particles. The latter is washed out while still in the magnetic field by means of a rinsing operation and is collected separately as middlings.

The magnetic material (concentrate) is washed out of the magnetic field by means of a powerful stream of water in a neutral area between magnetic fields. Thereafter, the boxes are again available for refilling as they enter the next magnetic field. The mode of operation is, because of the above procedure, continuous. The largest of these separators may process, for example, up to 200 tons per hour.

Another separator has a cylindrical groove in which steel balls are located for the formation of a magnetic field gradient. The groove rotates about a vertical axis. It is enclosed at four points, offset by 90° by two magnetic poles each, so that a horizontal magnetic field results. The charging of the slurry or sludge takes place in the area of the four magnetic fields. Magnetic material is retained between the balls by means of the magnetic forces and is flushed out after it has been turned out of the magnetic field together with the balls.

The charge quantity is appreciably less with the just-mentioned device then with the device equipped with pole plates, because more unfavorable flow conditions are present. In addition, these unfavorable flow conditions have the disadvantages result that it is difficult to recover a clean magnetic product.

Other magnetic separators also operate in a similar manner, for example, the rapid separator having inclined rods instead of a ball filling, or a separator of the Ore Research Institute at Prague, Czechoslovakia having expanded metal. Also, it has already been suggested to use bodies in the form of cylinder sections, steel wool, etc as ferromagnetic fillers.

SUMMARY OF THE INVENTION

The primary object of the present invention is to further improve the state of the art of magnetic separation, particularly in view of consideration of worldwide scarcity of metallic raw materials which, upon recognition thereof, requires those skilled in the art to attain a more economical preparation of minerals having an extremely low content of valuable materials, as through the introduction of high intensity magnetic field separation. There is, accordingly, an interest in always improving still further the state of the art of magnetic separation and, as mentioned above, this is the primary concern of the present invention.

According to the invention, a high intensity magnetic separator of the type generally mentioned above is improved in that the rotor is constructed as a hollow body and that the poles of different polarity are arranged together in the magnetic system so that the field of each magnetic system closes over a shorter path than heretofore known through the vertical wall of the rotor.

Preferably, the rotor is constructed as a hollow cylinder, that is, a body of low wall thickness in relation to the diameter of the cylinder.

In the case of a special construction of the high intensity magnetic field separator, use may also be made of a rotor construction in which the rotor is a hollow cone.

The wall which is inclined with respect to vertical of a rotor constructed as a hollow cone, in connection with the containers arranged on the periphery thereof, results in a particularly favorable sludge flow condition, in many cases for the separation function.

A particular embodiment of the high intensity magnetic separator results with such a conical construction in that the height of the rotor corresponds approximately to the outer distance of the magnetic poles and that the rotor has a container arrangement with ferromagnetic bodies at the height of each of the poles.

A concentration of the magnetic field lines in the high intensity magnetic separator constructed in accordance with the invention is attainable in, on and for the manner known per se, that the magnetic poles are tapered in the direction toward the container arrangement.

A particular advantage results from the construction of a high intensity magnetic field separator in accordance with the invention in that the rotor does not have a fixed center axis of rotation, but is supported on an axial ball bearing, ball turn table or rotating track, the support being radially outward of the axis of rotation.

Because of this type of mounting, the rotor requires no great inherent stability, whereby one is more free in the selection of rotor diameter than was heretofore the case, and thereby also finds freedom in the attainable total capacity of the magnetic separator.

A rotor constructed and supported in the above manner far exceeds, for example, the previously greatest structural diameter of such separators of approximately 4 m, whereby the way is left open for a manner of construction having an arrangement of a plurality of magnetic systems in a high intensity magnetic field separator. Appreciably lower limits heretofore experienced are therefore moved upwardly for the broadening of the capacity with a magnetic separator in a compact manner of construction than with the previously known devices of the category to which the invention pertains.

A further preferred arrangement of a high intensity magnetic separator constructed in accordance with the invention provides that the rotor comprises two rings of ferromagnetic material, each rotor being disposed at the height of a separate magnetic pole and each mounted for rotation about an axis and equipped with an arrangement of containers at the periphery thereof. For each magnetic system there is a magnet frame or yoke, fixed with respect to each magnet system and with respect to the rotating rings, which provides for a closing of the magnetic flux of the magnetic circuit through the rings and through the containers.

A solution to a particular problem is of concern with the present invention, namely the possibility of an individual adjustment of the magnetic field of each of the magnetic systems of the high intensity magnetic separator.

This is made possible, on the one hand, through the special construction of the magnetic separator according to the invention in that a magnetic circuit, i.e. an individual magnetic circuit, is correlated with each magnetic system. The mutual undesired influencing of such magnetic circuits may still further be diminished by dividing the rotor into paraxial segments which are magnetically isolated with respect to one another.

The advantageous manner of construction and operation is particularly further improved in respect of the utilization of capacity of the device in that two or more magnetic systems are arranged spaced apart about the cylinder, preferably at equal distances about the cylinder. Furthermore, it may be of particular advantage if, within the framework of the high intensity magnetic separator of the invention, use is made of the measure that the magnetic systems are constructed upon the principle of utilize super conducting coils.

Finally, because of the particular aforementioned construction, mutual influencing of individual magnetic systems is prevented to a great extent so that different excitations of the individual magnetic systems is possible without problems caused by interference.

With this measure, it is easy to selectively separate off substances in a slurry which have different susceptibilities in that, for example, the sludges or slurries are guided consecutively through different high intensity magnetic fields.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

Figure 1:
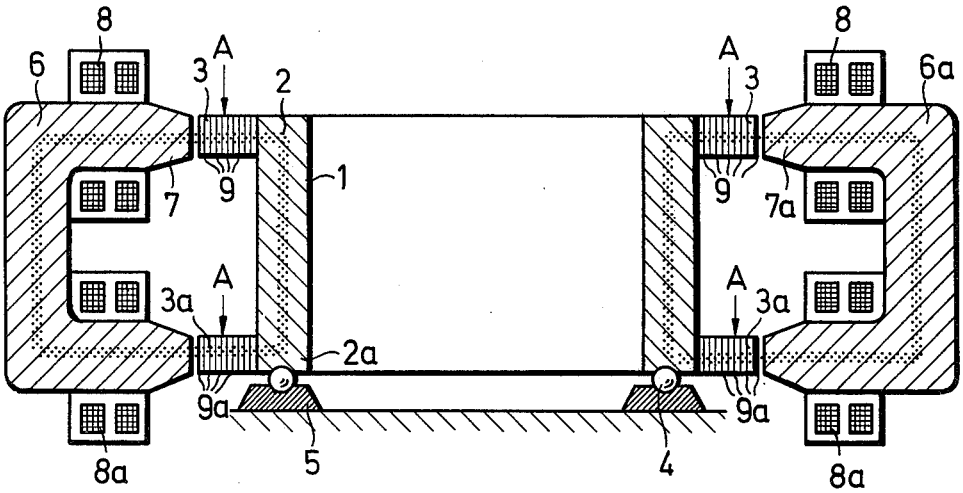
FIG. 1 is a sectional elevation taken through a high intensity magnetic separator constructed in accordance with the invention and shown as having a rotor in the form of a hollow iron cylinder with boxes arranged on the periphery thereof and containing ferromagnetic bodies, and further illustrating two of the magnetic systems.

Referring to FIG. 1, a high intensity magnetic separator is illustrated as comprising a rotor 1 which is constructed in the form of a hollow iron cylinder. The rotor 1 carries on the periphery of its upper part 2 a first row of boxes 3 and on the periphery of its lower part 2*a* a second row of boxes 3*a*. The rotor 1 is supported by a ball turntable or rotating track 4 positioned in a stationary outer bearing 5 so that the same is rotatable about a virtual vertical axis. Rotary drive of the rotor takes place with the aid of a rotary mechanism (not shown) with the most uniform speed possible.

A pair of magnetic systems 6 and 6*a* are located outside of and immediately adjacent the boxes 3 carried by the hollow rotor 1. Each of these systems, in a manner known per se, comprise iron yokes 7, 7*a* each of which is provided with a respective exciter coil 8, 8*a*.

A plurality of ferromagnetic bodies 9, 9*a*, for example pole plates, are located, preferably spaced apart, in the boxes 3, 3*a*.

The function of the apparatus is readily apparent from FIG. 1. The sludge or slurry flows through the boxes 3, 3*a* and between the plates 9, 9*a* in the boxes, from above, as symbolically indicated by the arrow A. Beneath the boxes, the non-discharged portion of the sludge is collected in grooves or troughs, commonly called collecting launders and carried off. The collecting launders, as well as similar troughs called feed launders, have not been illustrated on the drawing for the purpose of clarity. The magnetic material remains suspended on the plates 9, 9*a* during the passage of the slurry therethrough and is washed out by means of water after a box rotates out of the magentic field.

Figure 2:
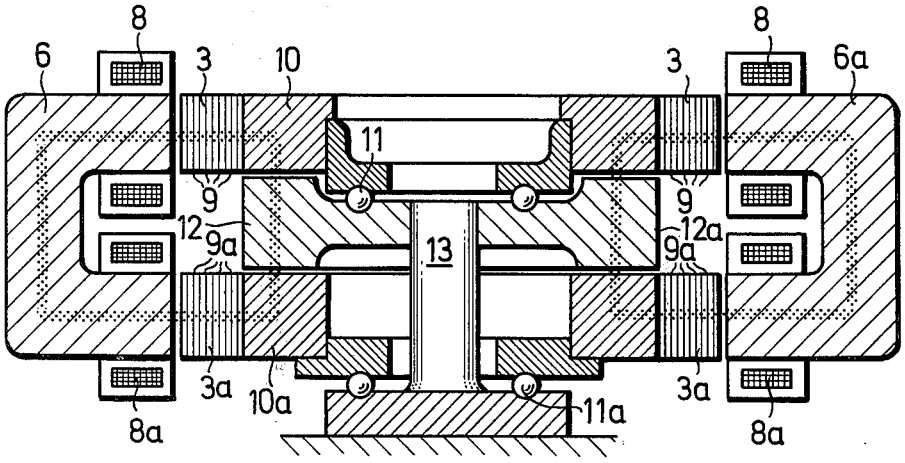
FIG. 2 is a similar sectional view of a magnetic separator having a rotor comprising two rings and a stationary frame or yoke between the rings.

In FIG. 2 an alternative embodiment of a high intensity magnetic separator is illustrated in which the rotor comprises two rings 10, 10*a* which are carried by respective ball bearings 11, 11*a*. A stationary magnet frame or yoke 12, 12*a* is arranged on a center carrier system 13 and, as illustrated in FIG. 2, may advantageously support the upper ring 10 via the bearing 11.

A plurality of boxes 3 is arranged on the periphery of the ring 10 and a similar plurality of boxes is arranged on the periphery of the ring 10*a*, the boxes containing four magnetic plates 9, 9*a*, respectively.

As in the structure of FIG. 1, magnetic systems 6, 6*a* having exciter coils 8, 8*a* are provided for the apparatus of FIG. 2. The apparatus of FIG. 2 functions in the same manner as the apparatus of FIG. 1. It is clear that with each magnet arrangement, the poles of different polarity are, in each case, arranged together, vertically aligned with each other and that the magnetic flux closes through the ferromagnetic plates 9, 9*a*, and the cylinder 1 (FIG. 1) and through the ferromagnetic plates 9, 9*a*, the rings 10, 10*a* and the frame 12 (FIG. 2).

Figure 3:
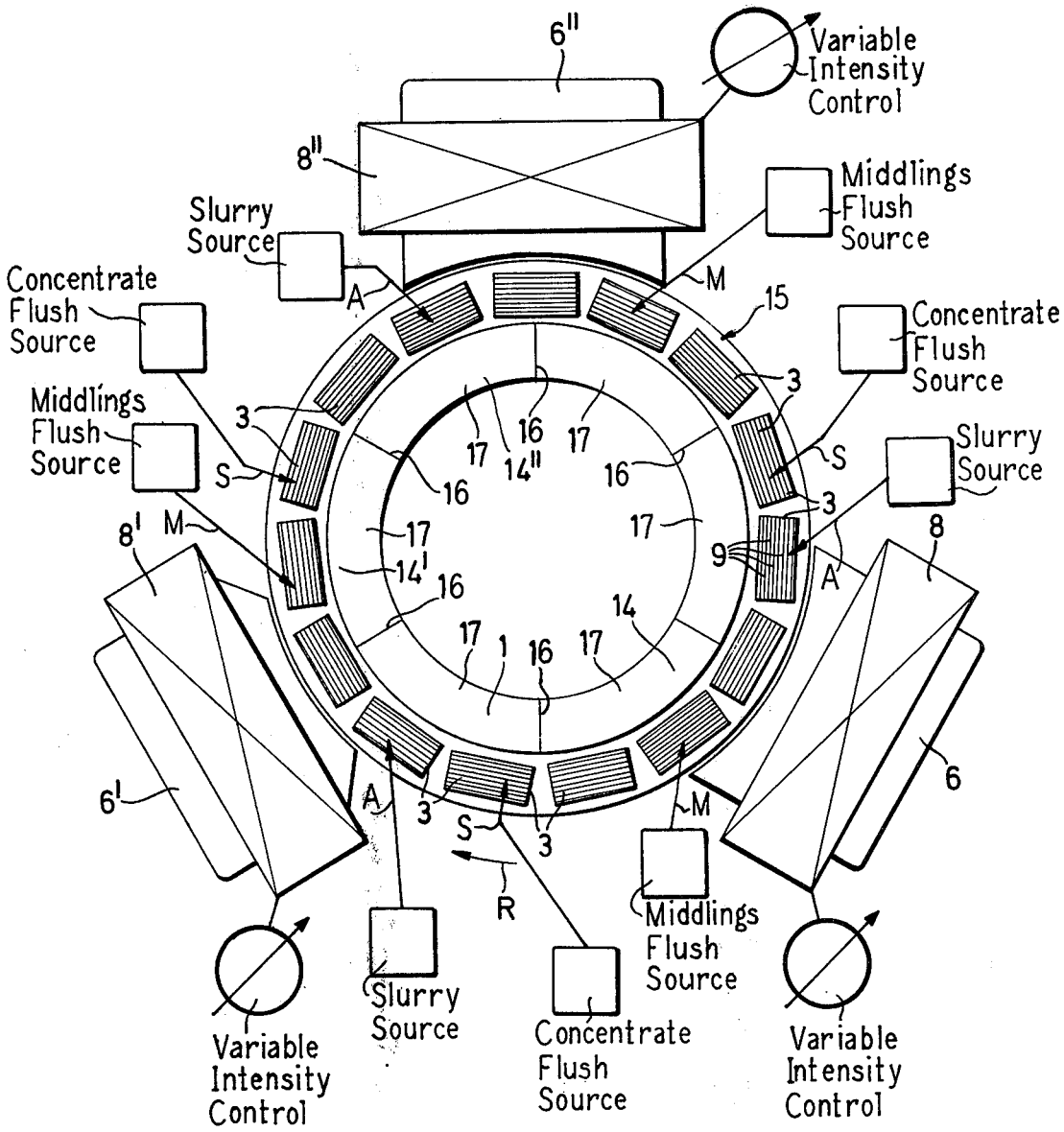
FIG. 3 is a plan view of a magnetic separator constructed in accordance with the invention and illustrated as having three magnetic systems.

Referring to FIG. 3, the rotor is illustrated as a hollow iron cylinder 15 which is separated by means of intermediate layers 16 into a plurality of individual paraxial segments 17 which are magnetically insulated from one another.

On the periphery, the rotor 15 carries a plurality of boxes 3 having the ferromagnetic bodies 9 supported therein in a spaced apart relation. The rotation of the cylindrically shaped rotor (or a similar construction according to FIG. 2 of rings) about a virtual vertical axis is indicated by the arrow R. Outside of the rotor 15 is a plurality, here three, magnetic systems 6, 6', 6'' each having a respective exciter coil 8, 8', 8''. At each of the points indicated by the arrow A, after entry of a box into one of the magnetic fields 14, 14', 14'', a slurry is charged into the boxes. A flushing and washing out of middlings takes place in each case at the points in the magnetic field indicated by the arrows M, as the boxes are leaving the magnetic field. The washing or scouring of the magnetic concentrate takes place, in each case, at the points indicated by the arrows S outside of the magnetic field, that is in a magnetically neutral location.

A high intensity magnetic field separator constructed according to the present invention, is not limited by the exemplary embodiments illustrated in FIGS. 1–3. A great number of magnetic systems may be provided, for example, according to the size of the rotating cylinder or rings. Also, the arrangement of the boxes having the ferromagnetic plates is to be understood to be only by way of example and is to be variable in type and manner. For example, instead of boxes, annularly shaped reception containers may be provided which have openings for the passage of the slurry therethrough and which are not sub-divided in the direction of rotation into individual containers. In these annularly shaped containers, preferably of non-magnetic material, for example, ball-shaped elements or elements of other ferromagnetic bodies may be present in which the magnetic material is retained within the field of each of the magnetic systems.

Also the magnets may be embodied in many forms other than those illustrated on the drawings and is variable within wide limits.

In addition, the rotor may be constructed as a hollow cone, as mentioned above, whereby the ferromagnetic plates are disposed inclined at an angle for longer periods of dwell which results as an advantage.

Although we have described our invention by reference to particular illustrative embodiments thereof and by reference to specific modifications, many other variations and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A high intensity magnetic separator for removing magnetizable particles from a slurry, comprising:

a hollow rotor mounted for rotation about a vertical axis and including a cylindrical outer wall;

a plurality of containers mounted above the periphery of said outer wall to receive a flow of slurry therethrough;

a plurality of magnetizable bodies in each of said containers for attracting and holding magnetizable particles from the slurry under the influence of a magnetic field;

a plurality of magnetic systems circumferentially spaced about said rotor for establishing magnetic fields and neutral zones therebetween, each of said magnetic systems comprising a pair of vertically aligned, opposite polarity magnetic poles adjacent said rotor and causing a closed flux path through said rotor wall and the adjacent containers parallel to said axis;

means for feeding the slurry to the containers as they rotate into each magnetic field; and means for flushing magnetic concentrate from said magnetizable bodies while the containers are in each neutral zone.

2. The separator of claim 1, wherein said rotor is a hollow cylinder.

3. The separator of claim 1, wherein said rotor is a hollow cone

4. The separator of claim 1, wherein the axial length of said rotor corresponds approximately to the distance between said poles of said magnet system.

5. The separator of claim 1, further comprising:

bearing means rotatably supporting said hollow rotor at the wall thereof radially outwardly of the axis of rotation.

6. The separator of claim 1, wherein said hollow rotor comprises:

a pair of rotatably mounted rings each located adjacent a respective magnetic pole and each carrying a plurality of said containers with corresponding ferromagnetic bodies therein; and a magnetic frame disposed between said rings to close the magnetic field between said poles and through said containers.

7. The separator of claim 1, wherein said rotor wall comprises a plurality of insulators spaced apart about said rotor in the direction of rotation which divide said rotor into a plurality of paraxial segments which are magnetically insulated from each other.

8. The separator of claim 1, comprising:

a plurality of said magnetic systems spaced about said rotor.

9. The separator of claim 1, comprising:

a plurality of said magnetic systems spaced about said rotor; and means for energizing said systems to provide magnetic fields of different intensity for selective separation of particles of different susceptibilities.

10. The separator of claim 1, further comprising:

means for controlling the magnetic intensity of each magnetic field for selective separation of magnetic particles of different susceptibilities.

* * * * *